US006417741B2

(12) United States Patent
Jodo

(10) Patent No.: US 6,417,741 B2
(45) Date of Patent: Jul. 9, 2002

(54) NONRECIPROCAL CIRCUIT DEVICE WITH AN INSULATING ADHESIVE TAPE ON THE YOKE

(75) Inventor: Takahiro Jodo, Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/798,712

(22) Filed: Mar. 2, 2001

(30) Foreign Application Priority Data

Mar. 3, 2000 (JP) ..... 2000-058576

(51) Int. Cl.[7] ..... H01P 1/32
(52) U.S. Cl. ..... 333/1.1; 333/24.2
(58) Field of Search ..... 333/1.1, 24.2

(56) References Cited

U.S. PATENT DOCUMENTS 6,121,851 A * 9/2000 Takane et al. ..... 333/1.1

OTHER PUBLICATIONS

US 6,118,349, 09/2000, Okada et al. (withdrawn)*

* cited by examiner

*Primary Examiner*—Justin P. Bettendorf
(74) *Attorney, Agent, or Firm*—Ostrolenk, Faber, Gerb & Soffen, LLP

(57) ABSTRACT

Insulating tape having an adhesive layer is applied to the lower face of the top wall of an upper yoke, by automated equipment or the like. The thickness of the insulating tape including the adhesive layer is set to a thin thickness, such as 0.01 to 0.05 mm for example, so that the height-wise dimensions of the product do not become great. Polyester resin, or material with deformation temperature of 200° C. or higher (e.g., polyimide resin, polyamide resin, fluororesin) is used for the material of the insulating tape. A silicone adhesive agent or an acrylic adhesive agent or the like is used for the adhesive layer of the insulating tape. Thus, short-circuiting between the matching capacitors and the yoke can be effectively prevented, thereby providing a nonreciprocal circuit device and communication device with high reliability at low costs.

14 Claims, 4 Drawing Sheets

NONRECIPROCAL CIRCUIT DEVICE WITH AN INSULATING ADHESIVE TAPE ON THE YOKE

BACKGROUND OF THE INVENTION

1. Field of the Invention

The present invention relates to a nonreciprocal circuit device, particularly to a nonreciprocal circuit device such as an isolator or circulator or the like used with microwave band communication devices, and to a communication device.

2. Description of the Related Art

Generally, lumped parameter isolators employed with mobile communication devices such as cellular telephones or the like have functions for allowing signals to pass only on the sending direction, and preventing sending thereof in the reverse direction. Also, demand for reductions in size, weight, and price has increased for recent mobile communication devices, which means that reductions in size, weight, and price is also demanded for isolators.

The following structure has been proposed for such lumped parameter isolators. That is, a resin terminal case is provided on a lower yoke formed of a magnetic metal, a center electrode assembly and matching capacitors and the like are accommodated in the terminal case, and an upper yoke formed of a magnetic metal is mounted. A permanent magnet is applied to the inner side of the upper yoke, and a DC magnetic field is applied to the center electrode assembly by this permanent magnet.

Now, this isolator prevents short-circuiting between the matching capacitor and upper yoke which are in close proximity, so a proposal has bene made to apply an insulating material (e.g., an epoxy resin) on the upper yoke so as to form an insulating film. However, in this case applying insulating material without irregularities so as to form a uniform film thickness is difficult, and in the event that there are irregularities in thickness, there is concern of the matching capacitor and the upper yoke short-circuiting at this portion. Also, the applying procedure would be complicated and inefficient, which would lead to increased cost.

SUMMARY OF THE INVENTION

Accordingly, it is an object of the present invention to prevent short-circuiting between the matching capacitor and yoke in a sure manner, and provide a nonreciprocal circuit device and a communication device with high reliability and low cost.

To this end, the nonreciprocal circuit device according to the present invention comprises:

a permanent magnet; a ferrite to which a direct current magnetic field is applied by the permanent magnet, the ferrite including a plurality of center electrodes; matching capacitors electrically connected to the center electrodes; a yoke for accommodating the permanent magnet, ferrite, center electrodes, and matching capacitors; wherein insulating tape having an adhesive layer is attached to a part of the yoke in the vicinity of the matching capacitors.

At least one of the matching capacitors is preferably arranged such that the electrode face of the capacitor defines an angle in a range of 60 degrees or more to 120 degrees or less with respect to said ferrite. Also, the insulating tape preferably comprises a material with a thermal deformation temperature of 200° C. or greater. Specifically, polyimide resin, polyamide resin, or fluororesin or the like may be used for the insulating tape, and a silicone adhesive agent or an acrylic adhesive agent may be used for the material of the adhesive layer of the insulating tape.

The above configuration prevents short-circuiting between the matching capacitor and the yoke with the insulating tape. The insulating tape has a uniform thickness, and there are no irregularities in film thickness, so short-circuiting between the matching capacitor and the yoke is reliably prevented.

Also, the communication device according to the present invention comprises a nonreciprocal circuit device with the above-described characteristics, and thus has high reliability with low manufacturing cost.

DESCRIPTION OF THE PREFERRED EMBODIMENTS

The following is a description of embodiments of the nonreciprocal circuit device and communication device according to the present invention, with reference to the attached drawings.

(First Embodiment, With Reference to FIGS. 1 through 6)

Figure 1:
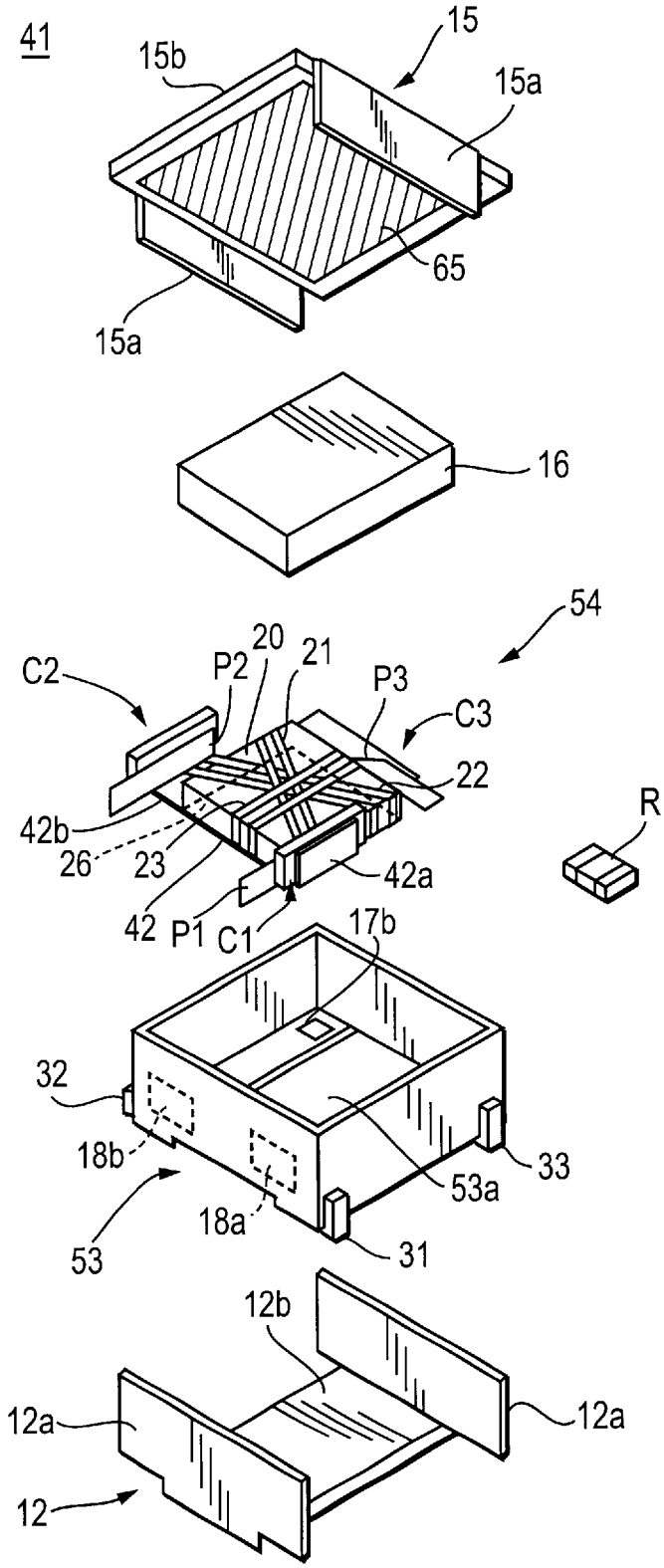
FIG. 1 is an exploded perspective view of an embodiment of the nonreciprocal circuit device according to the present invention.

FIG. 1 shows an exploded perspective view of the configuration of an embodiment of the nonreciprocal circuit device according to the present invention. As shown in FIG. 1, the nonreciprocal circuit device 41 is a lumped parameter isolator. The lumped parameter isolator 41 comprises a lower yoke 12, resin terminal case 53, center electrode assembly 54, permanent magnet 16, and an upper yoke 15.

The lower yoke 12 is made of a magnetic metal, and comprises left and right side walls 12*a* and a bottom wall 12*b*. The terminal case 53 is arranged on the lower yoke 12, with the center electrode assembly 54 being accommodated within the terminal case 53, and the upper yoke 15 made of a magnetic metal is mounted. The upper yoke 15 has side walls 15*a* and a top wall 15*b*.

Insulating tape 65 (shown as the hatched portion in FIG. 1) with an adhesive layer is attached to the lower face of the top wall 15*b* of the upper yoke 15 by automated equipment or the like. The thickness of the insulating tape 65 including the adhesive layer is set to a thin thickness, such as approximately 0.01 to 0.05 mm for example, so that the height dimension of the product does not become great. Polyester resin, or material with thermal deformation temperature of 200° C. or greater (e.g., polyimide resin, polyamide resin, fluororesin) is used for the material of the insulating tape 65. Using material with deformation temperature of 200° C. or greater is preferable, since the insulating tape 65 is not deformed at the time of mounting the isolator 41 with solder. Also, a silicone adhesive agent or an acrylic adhesive agent or the like is suitably sued for the adhesive layer of the insulating tape 65.

The permanent magnet 16 is attached to the surface of the insulating tape 65, so a to apply a DC magnetic field to the center electrode assembly 54 from this permanent magnet 16. The lower yoke 12 and the center electrode assembly 54 and upper yoke 15 form a magnetic path.

Figure 2:
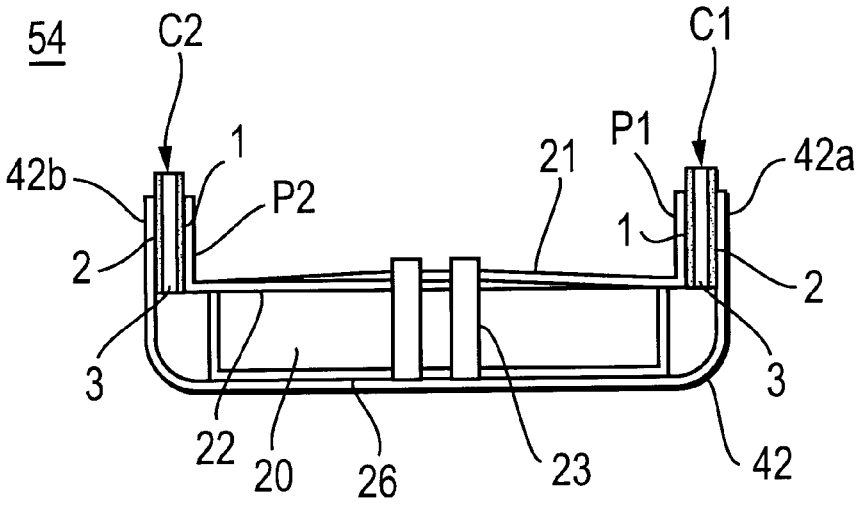
FIG. 2 is a frontal view of the center electrode assembly of the nonreciprocal circuit device shown in FIG. 1.
Figure 3:
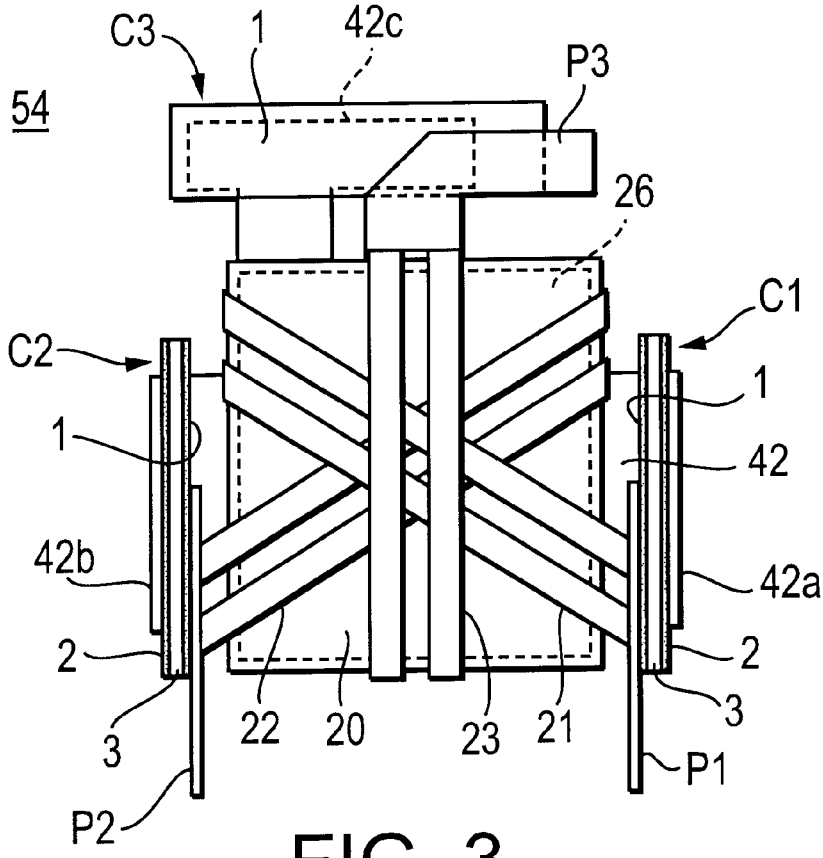
FIG. 3 is a plan view of the center electrode assembly shown in FIG. 2.

As shown in FIGS. 2 and 3, the center electrode assembly 54 has three center electrodes 21 through 23 intersecting one another at approximately 120 degree angles in an electrically insulating state on the upper face of the microwave ferrite 20 (the upper face being the first primary face, and also one magnetic pole face). Of the center electrodes 21 through 23, the center electrodes 21 and 22 each have port portions P1 and P2 on one end thereof, which is bent at right angle, and the center electrode 23 has a port portion P3 on one end thereof, which is extended horizontally. Further, the center electrodes 21 to 23 have a common shield portion 26 on the other end thereof, which is brought into contact with the lower face of the ferrite 20 (the second primary face, and also the other magnetic pole face). The common shield portion 26 substantially covers the entire lower face of the ferrite 20.

A ground plate 42 is arranged at the lower face of the ferrite 20, and comes into plane contact with the common shield portion 26 of the center electrodes 21 through 23 and is electrically connected thereto, if necessary solder or electroconductive adhesive agents or the like is used. Capacitor connecting portions 42*a*, 42*b*, and 42*c* extend from the end of the ground plate 42. The capacitor connecting portions 42*a* and 42*b* are raised so as to be parallel to the port portions P1 and P2 of the center electrodes 21 and 22, and the capacitor connecting portion 42*c* extends horizontally so as to be parallel to the port portion P3 of the center electrode 23. The ground plate 42 is connected to the bottom wall 12*b* of the lower yoke 12 through a window 53*a* of the terminal case 53, and thus is grounded.

The hot-side capacitor electrodes 1 of the matching capacitors C1 through C3 are soldered to the port portions P1 through P3, and the cold-side capacitor electrodes 2 thereof are soldered to the capacitor connecting portions 42*a*, 42*b*, and 42*c* of the ground plate 42. At this time, the capacitor electrode surfaces 1 and 2 of the matching capacitors C1 and C2 are arranged so as to define an angle in a range of approximately 60 degrees or more to 120 degrees or less with respect to the upper surface of the ferrite 20. The angle thereof was set to approximately 90 degrees for this first embodiment. On the other hand, the matching capacitor C3 is arranged such that the capacitor electrodes surfaces 1 and 2 thereof are substantially parallel to the upper surface of the ferrite 20. Each of the matching capacitors C1 through C3 are single plate capacitors with capacitor electrodes 1 and 2 formed on both sides of a dielectric substrate 3.

The matching capacitors C1 through C3 can be mounted as described next, for example. That is, assuming that capacitor connection portions 42*a* and 42*b* are to be raised, bent portions are provided to the base portions of the ground plate 42 beforehand, so that there is leeway dimensionswise. Solder paste is applied on the capacitor connection portions 42*a* through 42*c* of the ground plate 42, and the matching capacitors C1 through C3 are placed thereupon with the cold-side capacitor electrodes 2 facing down.

Further, after solder paste is applied on the hot-side capacitor electrodes 1 of the matching capacitors C1 through C3, the ferrite 20 including the center electrodes 21 through 23 is placed thereon. The common shield portion 26 of the center electrodes 21 through 23 is brought into plane contact with the upper face of the ground plate 42, and the port portions P1 through P3 are brought into plane contact with the hot side capacitor electrodes 1 of the matching capacitors C1 through C3 respectively, by solder paste. In this state, the solder paste is heated, thereby the matching capacitors C1 through C3 are soldered. Next, the capacitor connection portions 42*a* and 42*b* and the port portions P1 and P2 are bent, and the matching capacitors C1 and C2 are arranged such that the capacitor electrode surfaces 1 and 2 define the angle in the range of approximately 60 degrees or more to 120 degrees or less with respect to the upper surface of the ferrite 20. Thus, a center electrode assembly 54 is obtained.

Input/output electrodes 31 and 32 and ground terminals 33 are insert-molded to the terminal case 53. The input/output electrodes 31 and 32 each have one end exposed from an outer side wall of the case 53, and the other end is exposed at an inner wall of the case 53 so as to form input/output connection electrode portions 18*a* and 18*b*. In the same way, each of the ground terminals 33 has one end exposed from an outer side wall of the case 53, and the other end is exposed at an inner bottom wall of the case 53 so as to form ground connection electrode portions 17*a* and 17*b* (see FIG. 4).

Figure 4:
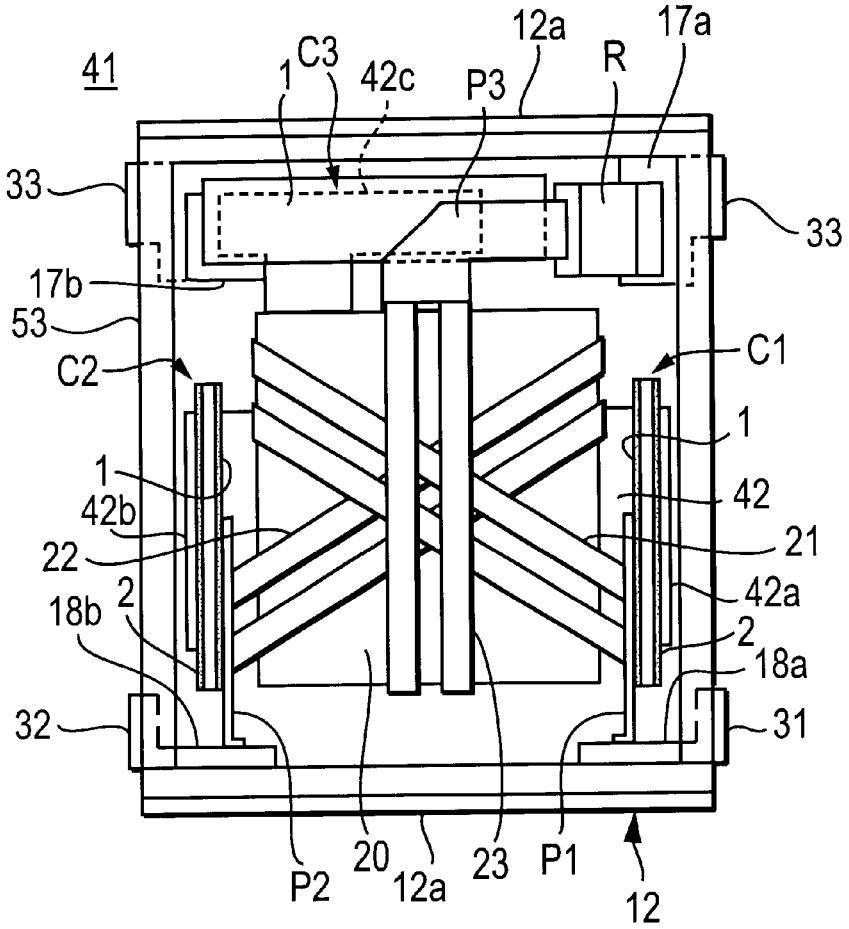
FIG. 4 is a plan view illustrating the internal structure of the nonreciprocal circuit device shown in FIG. 1.
Figure 5:
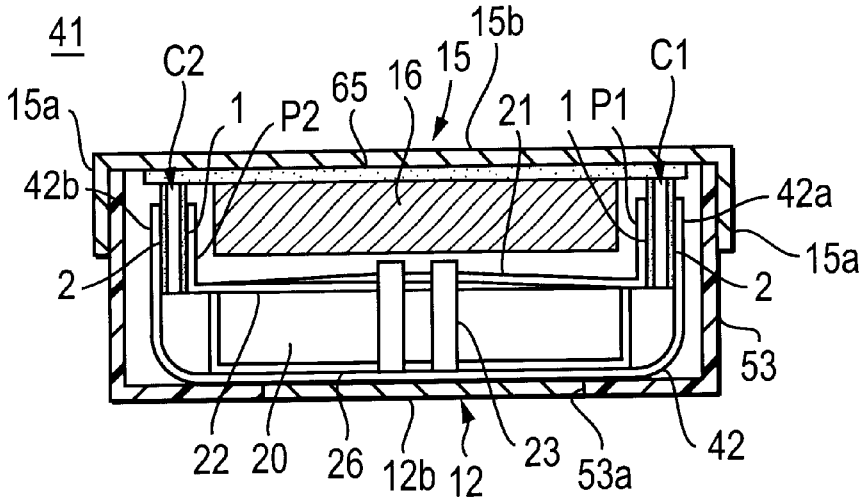
FIG. 5 is a partial cross sectional view of the nonreciprocal circuit device shown in FIG. 1.
Figure 6:
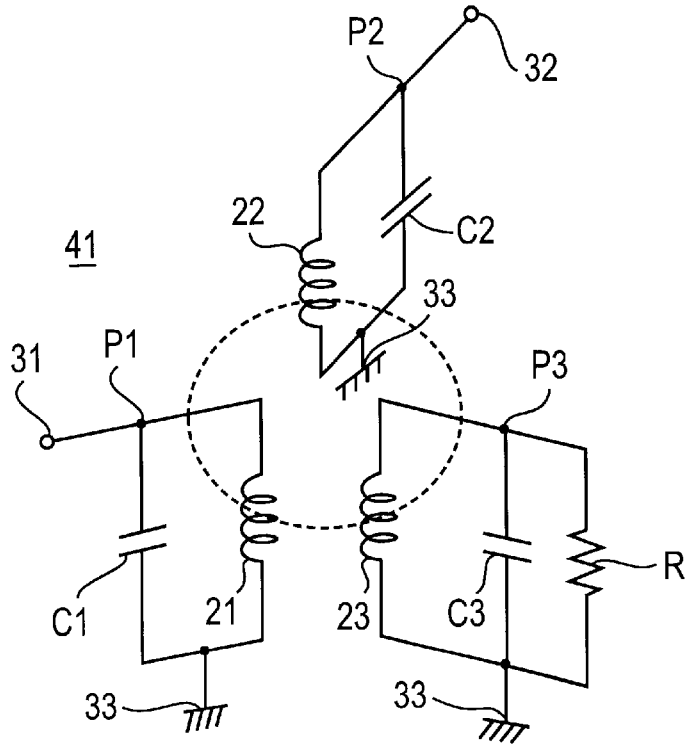
FIG. 6 is an electrical equivalency circuit of the nonreciprocal circuit device shown in FIG. 1.

As shown in FIGS. 4 and 5, the center electrode assembly 54 and a terminal electrode R are accommodated within the terminal case 53 thus configured. The port portions P1 and P2 of the center electrodes 21 and 22 are respectively connected to the input/output connection electrode portions 18*a* and 18*b* by soldering or the like. One end of the terminal electrode R is connected to the ground connection electrode portion 17*a*, and the other end thereof is connected to the port portions P3 of the center electrode 23. The capacitor connection portion 42*c* is connected to the ground connection electrode portion 17*b*. FIG. 6 shows an electrical equivalent circuit for the isolator 41.

The isolator 41 thus configured has matching capacitors C1 through C3 respectively mounted between the port portions P1 through P3 of the center electrodes 21 through 23 and the capacitor connection portions 42*a* through 42*c* of the ground plate 42, so the matching capacitors C1 through C3, the center electrodes 21 through 23, and the ground plate 42 and the ferrite 20 can be handled as a single unit, thus facilitating manufacturing of the isolator 41.

Also, as shown in FIG. 5, insulating tape 65 is attached on the face of the upper yoke 15 facing the matching capacitors C1 and C2, on the face wherein the upper yoke 15 and the matching capacitors C1 and C2 come into close proximity, i.e., insulating tape 65 is arranged between the upper yoke 15 and the matching capacitors C1 and C2, so short-circuiting between the upper yoke 15 and the matching capacitors C1 and C2 is prevented by the insulating tape 65. The insulating tape 65 has a uniform thickness with no irregularities in the thickness thereof, so short-circuiting between the upper yoke 15 and the matching capacitors C1 and C2 can be effectively prevented. Moreover, the insulating tape 65 has been attached to the upper yoke 15 by an adhesive layer, so there is no undesired positional shifting of the insulating tape 65, and short-circuiting between the upper yoke 15 and the matching capacitors C1 and C2 due to positional shifting of the insulating tape 65 can also be prevented. Consequently, the reliability of the isolator 41 improves.

The second embodiment will be described with a cellular phone serving as an example of the communication device according to the present invention.

Figure 7:
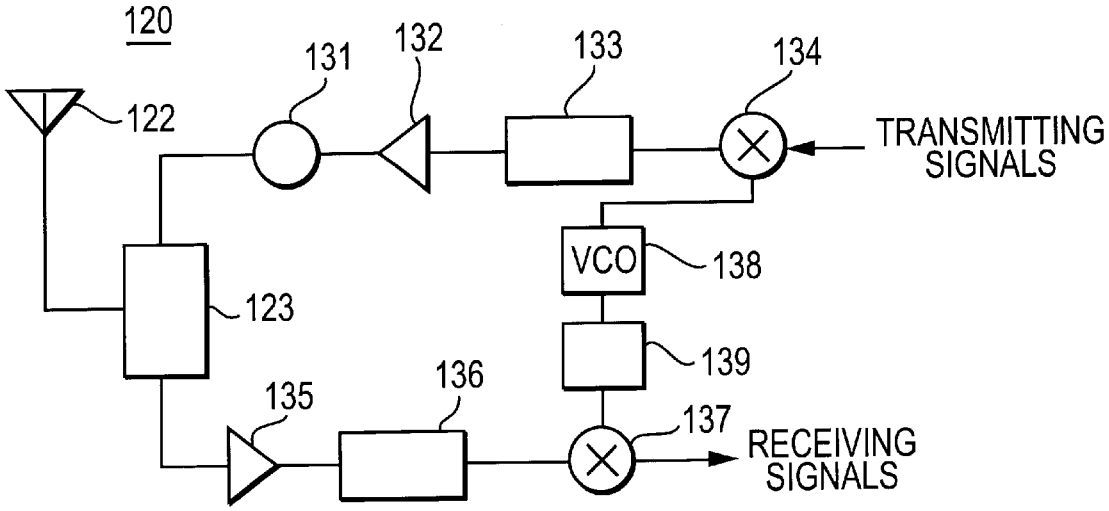
FIG. 7 is a block diagram illustrating an embodiment of the communication device according to the present invention.

FIG. 7 is an electric circuit block diagram of the RF unit of a cellular phone 120. In FIG. 7, reference numeral 122 denotes an antenna device, 123 a duplexer, 131 a transmitting side isolator, 132 a transmitting side amplifier, 133 a transmitting side interstage band-pass filter, 134 a transmitting side mixer, 135 a receiving side amplifier, 136 a receiving side interstage band pass filter, 137 a receiving side mixer, 138 a voltage control oscillator (VCO), and 139 a local band-pass filter.

Now, the lumped parameter isolator 41 according to the first embodiment can be used as the transmitting side isolator 131. Mounting this isolator 41 realizes a low-cost high-reliability cellular phone.

The present invention is by no means restricted to the above embodiments; rather, various configurations may be made within the spirit and scope of the present invention. For example, in the first embodiment, two matching capacitors C1 and C2 are positioned perpendicular and the other matching capacitor C3 is positioned sideways (i.e., placed so that the capacitor electrode face is parallel to a horizontal plane), but all three of the matching capacitors C1 through C3 may be positioned perpendicularly (i.e., placed so that the capacitor electrode face is perpendicular to a horizontal plane). That is to say, at least one of the matching capacitors may be arranged such that the capacitor electrode face defines an angle of 60 degrees or more but 120 degrees or less as to the ferrite.

Also, mounting of the matching capacitors C1 through C3 may be performed by using an electroconductive adhesive agent instead of soldering. The matching capacitors C1 through C3 may be monolithic capacitors instead. Also, the present invention can also be applied to nonreciprocal circuit devices employed for other high-frequency parts such as circulators and the like, besides isolators. Further, in addition to forming by punching and bending a metal plate, the center electrodes can also be formed by providing pattern electrodes on a substrate (such as a dielectric substrate, magnetic substance substrate, laminated substrate, etc.).

As can be clearly understood from the above description, according to the present invention, short-circuiting of the yoke and capacitors is prevented by insulating tape. At this time, the insulating tape has uniform thickness with no irregularities in the thickness thereof, so short-circuiting between the yoke and the capacitors can be effectively prevented, thereby obtaining a nonreciprocal circuit device and communication device with high reliability. Also, the insulating tape is easily applied with an adhesive player, and thus the insulating tape can be applied to the yoke with automated equipment, thereby improving work efficiency and reducing manufacturing costs.

What is claimed is:

1. A nonreciprocal circuit device, comprising:

a permanent magnet;

a ferrite to which a direct current magnetic field is applied by said permanent magnet, said ferrite including a plurality of center electrodes;

matching capacitors electrically connected to said center electrodes; and a yoke for accommodating said permanent magnet, ferrite, center electrodes, and matching capacitors;

wherein an insulating tape having an adhesive layer is attached to a part of said yoke in the vicinity of said matching capacitors.

2. A nonreciprocal circuit device according to claim 1, wherein at least one of said matching capacitors is arranged such that the electrode surface of the capacitor defines an angle in a range of 60 degrees or more to 120 degrees or less with respect to said ferrite.

3. A nonreciprocal circuit device according to either claim 1 or claim 2, wherein said insulating tape comprises a material with a thermal deformation temperature of approximately 200° C. or greater.

4. A nonreciprocal circuit device according to claim 3, wherein said insulating tape comprises polyimide resin, polyamide resin, or fluororesin.

5. A nonreciprocal circuit device according to claim 4, wherein said adhesive layer of said insulating tape comprises either a silicone adhesive agent or an acrylic adhesive agent.

6. A communication device comprising at least one nonreciprocal circuit device according to any of the claims 1 and 2.

7. A nonreciprocal circuit device according to claim 1, wherein said insulating tape comprises polyimide resin, polyamide resin, or fluororesin.

8. A nonreciprocal circuit device according to claim 7, wherein said adhesive layer of said insulating tape comprises either a silicone adhesive agent or an acrylic adhesive agent.

9. A nonreciprocal circuit device according to claim 2, wherein said insulating tape comprises polyimide resin, polyamide resin, or fluororesin.

10. A nonreciprocal circuit device according to claim 9, wherein said adhesive layer of said insulating tape comprises either a silicone adhesive agent or an acrylic adhesive agent.

11. A nonreciprocal circuit device according to claim 1, wherein said adhesive layer of said insulating tape comprises either a silicone adhesive agent or an acrylic adhesive agent.

12. A nonreciprocal circuit device according to claim 2, wherein said adhesive layer of said insulating tape comprises either a silicone adhesive agent or an acrylic adhesive agent.

13. A nonreciprocal circuit device according to claim 3, wherein said adhesive layer of said insulating tape comprises either a silicone adhesive agent or an acrylic adhesive agent.

14. A communication device according to claim 6, further comprising at least one of a transmitting circuit and a receiving circuit, connected to said nonreciprocal circuit device.

* * * * *